United States Patent [19]

Böhm

[11] 3,958,810

[45] May 25, 1976

[54] SKI WITH TOP EDGE PORTIONS OF PLASTIC MATERIAL AND DEVICE FOR SECURING THE EDGE PORTIONS DURING MANUFACTURE

[76] Inventor: Walter Böhm, Ort 143, A-6322 Kirchbichl, Tirol, Austria

[22] Filed: Jan. 13, 1975

[21] Appl. No.: 540,694

[30] Foreign Application Priority Data

Jan. 21, 1974 Austria ..... 481/74

[52] U.S. Cl. ..... 280/610; 156/79; 249/91; 280/608; 425/127

[51] Int. Cl.[2] ..... A63C 5/04; A63C 5/12

[58] Field of Search ..... 280/11.13 N, 11.13 J, 280/11.13 E, 11.13 R, 11.13 L; 156/79, 245; 249/85, 93, 95, 91; 264/46.5, 46.7; 425/123, 127

[56] References Cited

UNITED STATES PATENTS

| | | | |
|---|---|---|---|
| 3,439,732 | 4/1969 | Andreoli | 249/91 |
| 3,535,986 | 10/1970 | Daub | 249/95 |
| 3,580,596 | 2/1969 | Volkl | 280/11.13 N |
| 3,635,482 | 1/1972 | Holman | 280/11.13 L |
| 3,807,746 | 4/1974 | Kofler | 280/11.13 L |
| 3,816,573 | 6/1974 | Hashimoto et al. | 280/11.13 L |
| 3,879,245 | 4/1975 | Fetherston et al. | 156/245 |

*Primary Examiner*—M. H. Wood, Jr.
*Assistant Examiner*—David M. Mitchell
*Attorney, Agent, or Firm*—John J. Dennemeyer

[57] ABSTRACT

The top edge portions of a ski of plastic material are produced in a two-part mold by placing the bottom surface sheet and edge portions of the ski on the floor of the mold while preformed top edge portions carry the top surface sheet and are supported in the mold by an auxiliary strip which extends outwardly from its side surface and rests on two opposite walls of the mold box. The auxiliary strips are held in place by magnets lodged in the opposite mold walls while the mold is open. After closing the mold with the mold lid a plastic foam material in the mold is expanded to produce the ski core and bond together the top and bottom surface sheets and edge portions of the ski. The auxiliary strips are severed from the top edge portions to finish the ski.

7 Claims, 4 Drawing Figures

FIG. 1.
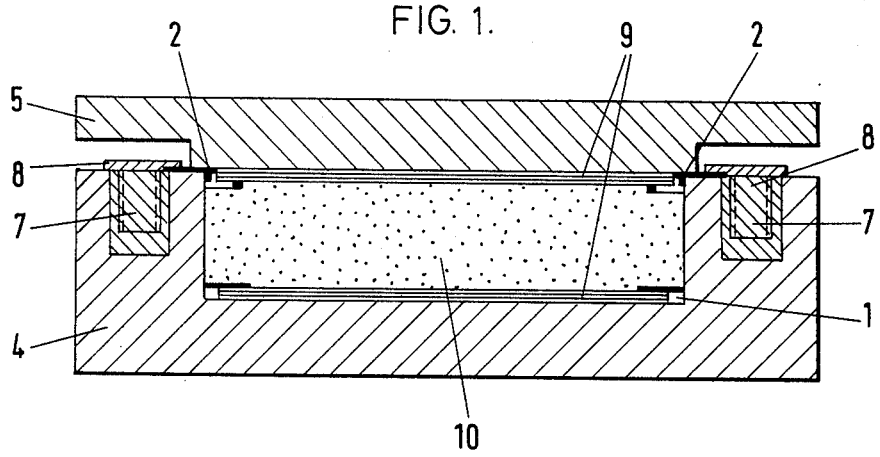
FIG. 3.
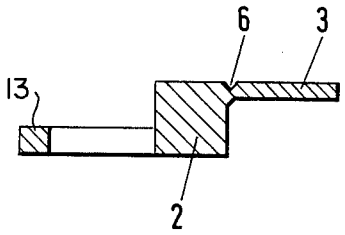
FIG. 2.
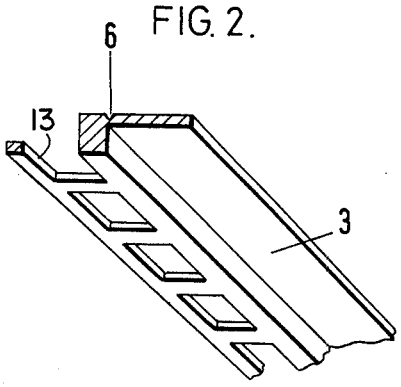
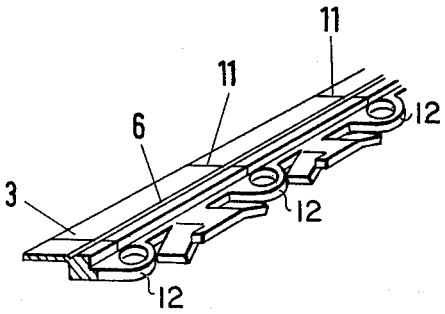
FIG. 4.

SKI WITH TOP EDGE PORTIONS OF PLASTIC MATERIAL AND DEVICE FOR SECURING THE EDGE PORTIONS DURING MANUFACTURE

The present invention relates to a ski of plastic material with a plastic foam core whose top edge portions of plastic material are preformed and carry a laterally extending auxiliary strip, and to a device for securing these edge portions in a ski mold.

It is already known to employ plastic foam material to form the core of a ski. This foam material is bonded to the other parts of the ski, namely the top and bottom surface sheets and their edge portions. The manufacture of such skis requires a considerable amount of labor.

The cost of labor is substantially reduced when the skis are produced in a mold. During this type of manufacture all the parts of the ski are placed in the mold and subsequently bonded together by a plastic foam material, for example polyurethane, which is introduced into the mold and expanded. As mentioned above all the parts of the ski must be placed into the open mold. In the case of metal parts, as for example the metal running edges on the bottom surface sheet of the ski, the fixing of the metal edges and the plastic bottom surface can be obtained by magnets. This is different for the top edges which are made of non-metallic material in many instances, so that it is not possible to secure them in the mold by means of magnets.

In German Pat. No. 2,130,279 it is already known to clamp the top surface sheet during expansion of a plastic foam material between the top and bottom parts of the mold, and the projecting parts of the top surface sheet are removed when the foaming action is completed. In this method of producing plastic skis the application of the ski top edges is not possible because they cannot be clamped as in the case of the top surface sheet simply between the top and bottom mold parts.

It is therefore an object of the invention to provide preformed top edge portions for a ski and a device for securing these edge portions in a mold in a simple manner.

This is obtained in the case of a ski top edge portion for a plastic ski with a plastic foam core by placing all the parts of a ski, such as the top and bottom surface sheet and the top ski edges, in a mold which is filled with a plastic foam material susceptible of expanding, for example polyurethane, in order to form the core of the ski, and fixing the surface sheet in position by exerting a clamping force on portions of the surface sheet which extend beyond the side surfaces of the finished ski between the mold lid and the mold box whose separation line coincides essentially with the top surface sheet of the ski. After expanding the plastic foam material in the mold the portions which extend past the side surfaces of the ski are removed. According to the invention the top edge portion of the ski is provided with an auxiliary strip which extends from the side of this edge portion located on the side of the finished ski and is aligned substantially with the surface sheet of the top edge portions located at the surface sheet of the finished ski. The auxiliary strip extends preferably over the entire length of the top edge portion. According to an additional feature of the invention the auxiliary strip is subdivided in the longitudinal direction of the top edge portion by transversely extending slots whereby the ski top edge portion can be easily adapted to the mold. In order to facilitate the severing of the auxiliary strip from the finished ski, a notch is provided, for example at the joining area between the top edge portion and the auxiliary strip.

The ski top edge portion is held in position by the mold lid as soon as the mold is closed but the auxiliary strip is necessary to support the top edge portions and the top surface sheet until and mold is completely closed. To secure the auxiliary strip magnets are lodged in the side walls of the mold box along the mold inner space at a suitable distance from this space. The armatures of the magnets have plates which extend over the outer edge of the auxiliary strip. This manner of fixing the ski top edge has the advantage that in case the foam escapes between the mold lid and the mold box no fixedly mounted retainer means can be soiled.

Additional details and features of the invention will become apparent from the following description given in combination with the attached drawing in which:

FIG. 1 shows a section through a two-part mold for producing a ski,

FIG. 2 shows a ski top edge portion according to the invention in a perspective view, FIG. 3 shows a section of the ski top edge portion according to FIG. 2 and, FIG. 4 shows a ski top edge portion according to the invention formed as a link edge.

The mold for producing a ski of plastic material with a plastic foam core consists of a mold box 4 and mold lid 5. The bottom edge portion 1 and the bottom surface sheet of the ski are placed into the mold box. The two bottom edge portions are of metallic material and may be retained in position together with the bottom surface sheet 9 of plastic material on the floor of the mold box by magnets (not shown).

In order to support the preformed top edge portions 2 of the ski in the mold they are provided with an auxiliary strip 3 as illustrated in FIGS. 2, 3 and 4 of the drawing. Slots 11 extend transversely across the top edge portions 2 and across the auxiliary strips 3 dividing the top edge portion into individual sections called link edges. Semi-arc shaped connecting pieces 12 interconnect the individual link edges and their associated auxiliary strips. By means of the auxiliary strips 3 the ski top edge portions are supported at the separation surface of the mold in such a way that the top edge portion is located in the hollow space of the mold. In order to hold the top edge portion 2 in position while the mold is open a series of magnets 7 are lodged in a vertical position in the mold box walls adjacent the hollow space of the mold. The magnets 7 have armature plates 8 which extend partly over the auxiliary strip 3 of the ski top edge portions 2 and are able to press the strips 3 down against the top of the mold box walls. The top surface sheet 9 of the ski may now be placed on supporting means 13 of the secured ski top edge portion, and the lid 5 of the mold may be put in position to close the mold. The mold lid thus takes over the pressing or clamping function of the armature plates as it rests on the auxiliary strip 3 on top of the mold well. After the plastic foam material has expanded in the mold the completed ski is removed and the auxiliary strips 3 of the top edge portions 2 which extend over the side of the ski are severed at notch 6.

What is claimed is:

1. A ski comprising:

a bottom surface sheet;

bottom edge portions;

a top surface sheet;

top edge portions; and a core formed of expanded plastic foam material for bonding together said bottom surface sheet, said bottom edge portions, said top surface sheet, and said top edge portions;

said top edge portions having auxiliary strips aligned with the surface of said top edge portions located at the surface of the ski and extending outwardly from the side of the top edge portions, said top edge portions additionally having means for supporting said top surface sheet prior to the formation of said core.

2. A ski according to claim 1 wherein said auxiliary strips extends along the entire length of said top edge portion.

3. A ski according to claim 2 wherein said auxiliary strip is subdivided in the longitudinal direction of said top edge portions by transversely extending slots.

4. A ski according to claim 1 wherein a weakened area is provided between said top edge portions and said auxiliary strip.

5. A ski according to claim 4 wherein said weakened area is a longitudinally extending notch.

6. A method for producing a ski including the steps of:

providing a mold comprising a mold lid and a mold box having side walls adjacent an inner space;

providing a bottom surface sheet and bottom edge portions;

placing the bottom surface sheet and the bottom edge portions on the floor of the inner space of the mold box;

providing a top surface sheet and top edge portions, the top edge portions having auxiliary strips and supporting means;

securing the auxiliary strips on the mold box side walls;

supporting the top surface sheet over the inner space by placing the top surface sheet on the supporting means of the top edge portions;

closing the mold with the mold lid thereby clamping the auxiliary strips between the mold lid and the mold box side walls;

providing a plastic foam material in the mold;

expanding the plastic foam material thereby forming the core of the ski and bonding together the bottom surface sheet, the bottom edge portions, the top surface sheet, and the top edge portions;

separating the mold lids and the mold box;

removing the ski core from the mold box; and severing the auxiliary strips from the top edge portions.

7. A method of producing a ski according to claim 6 wherein said top edge portions are formed of a non-magnetic material and wherein said mold box has magnets lodged in spaced relation in the side walls adjacent the inner space, said magnets having associated armatures plates;

and wherein said method for securing said auxiliary strips on the mold box side wall comprises:

placing the auxiliary strips on the mold box side wall; and overlying the auxiliary strips by the armature plates so as to press the auxiliary strips against the top of the mold box side walls.

* * * * *